US011034547B2

(12) United States Patent
Gainche et al.

(10) Patent No.: US 11,034,547 B2
(45) Date of Patent: Jun. 15, 2021

(54) METHOD FOR OPERATING AN ELEVATOR SYSTEM

(71) Applicant: TK Elevator Innovation and Operations GmbH, Essen (DE)

(72) Inventors: Philippe Gainche, Großbettlingen (DE); Marius Matz, Filderstadt (DE); Martin Madera, Neuhausen (DE)

(73) Assignee: TK Elevator Innovation and Operations GmbH, Düsseldorf (DE)

( * ) Notice: Subject to any disclaimer, the term of this patent is extended or adjusted under 35 U.S.C. 154(b) by 6 days.

(21) Appl. No.: 16/462,737

(22) PCT Filed: Nov. 14, 2017

(86) PCT No.: PCT/EP2017/079215
§ 371 (c)(1),
(2) Date: May 21, 2019

(87) PCT Pub. No.: WO2018/091471
PCT Pub. Date: May 24, 2018

(65) Prior Publication Data

US 2020/0062548 A1 Feb. 27, 2020

(30) Foreign Application Priority Data

Nov. 21, 2016 (DE) ..... 10 2016 222 837.4

(51) Int. Cl.
*B66B 9/00* (2006.01)
*B66B 1/36* (2006.01)
*B66B 7/02* (2006.01)

(52) U.S. Cl.
CPC ..... *B66B 9/003* (2013.01); *B66B 1/36* (2013.01); *B66B 7/026* (2013.01)

(58) Field of Classification Search
CPC ..... B66B 9/003; B66B 7/021
See application file for complete search history.

(56) References Cited

U.S. PATENT DOCUMENTS

2016/0288809 A1 10/2016 Sornik
2017/0107080 A1 4/2017 Steinhauer
2018/0257911 A1 9/2018 Gainche

FOREIGN PATENT DOCUMENTS

CN 203451954 U 2/2014
CN 203921933 U 11/2014
(Continued)

OTHER PUBLICATIONS

Machine Translation JP 2007-131402.*
(Continued)

*Primary Examiner* — Diem M Tran
(74) *Attorney, Agent, or Firm* — William J. Cassin

(57) ABSTRACT

An elevator system may comprise a vertical guide rail, a horizontal guide rail, a shaft relative to which at least one of the first or second guide rail is kept stationary, a rotatable rail segment, a car that is movable along the guide rails and switchable between the first and second guide rails via the rail segment, and locking devices configured to selectively secure an orientation of the car and/or the rail segment. A method for operating the elevator system may involve positioning the car into a transfer position on the rail segment while the rotatable rail segment is aligned with the first guide rail, rotating the rail segment into alignment with the second rail segment whereby movement of the rail segment is braked by a rotary brake, and securing the rotational position of the rail segment relative to the shaft with one of the locking devices.

15 Claims, 7 Drawing Sheets

(56) References Cited

FOREIGN PATENT DOCUMENTS

| | | | | | |
|---|---|---|---|---|---|
| CN | 204508498 | U | | 7/2015 | |
| CN | 104876089 | A | | 9/2015 | |
| CN | 105939764 | A | | 9/2016 | |
| CN | 106163963 | A | | 11/2016 | |
| CN | 106185546 | A | | 12/2016 | |
| CN | 107324181 | A | | 11/2017 | |
| DE | 10 2014 220 966 | A | | 4/2016 | |
| DE | 102016205794 | A | | 10/2017 | |
| DE | 102016211997 | A | | 1/2018 | |
| IE | 102015218025 | A | | 3/2017 | |
| JP | H04148785 | A | | 5/1992 | |
| JP | 04191279 | A | * | 7/1992 | ..... B66B 7/021 |
| JP | 04191280 | A | * | 7/1992 | ..... B66B 7/021 |
| JP | H0648672 | A | | 2/1994 | |
| JP | 2701960 | B | | 1/1998 | |
| JP | 2788366 | B2 | * | 8/1998 | |
| JP | 2007131402 | A | | 5/2007 | |
| WO | 2015/144 781 | A | | 10/2015 | |

OTHER PUBLICATIONS

Machine Translation CN 104876089.*
English Translation of International Search Report issued in PCT/EP2017/079215, dated Mar. 15, 2018.

* cited by examiner

METHOD FOR OPERATING AN ELEVATOR SYSTEM

CROSS REFERENCE TO RELATED APPLICATIONS

This application is a U.S. National Stage Entry of International Patent Application Serial Number PCT/EP2017/079215, filed Nov. 14, 2017, which claims priority to German Patent Application No. DE 10 2016 222 837.4, filed Nov. 21, 2016, the entire contents of both of which are incorporated herein by reference.

FIELD

The present disclosure generally relates to elevator systems, including methods for operating elevator systems.

BACKGROUND

A generic elevator system comprises:

at least one first guide rail which is oriented in a first, in particular vertical, direction, at least one second guide rail which is oriented in a second, in particular horizontal, direction, at least one shaft in respect of which at least one of the guide rails is kept stationary;

at least one rail segment which can be rotated in respect of the shaft and which can be switched between an orientation in the first direction and an orientation in the second direction, at least one elevator car which can be moved along the guide rails by means of a chassis and which can be switched between the different guide rails via the rotatable rail segment, said car being rotatably connected to the chassis via a rotary joint, an assembly of locking devices which is designed to temporarily secure an orientation of the car and/or of the rotatable track segment.

DE 10 2014 220 966 A1 discloses an elevator system in which a plurality of elevator cars are operated cyclically in closed-loop operation in a similar manner to a paternoster lift. Unlike the traditional paternoster lift, each car is driven independently of the other cars and can therefore stop independently of the other cars at any arbitrary stopping point. Transfer devices are provided in order to switch the cars from a vertical traveling direction into a horizontal traveling direction, so that the car can thereby be moved between different elevator shafts. In this way, the elevator cars can be moved into a single plane which is spanned by the two elevator shafts and the transverse shafts connecting these.

Thus a need exists for improving the safety of elevator systems.

DETAILED DESCRIPTION

Figure 1:
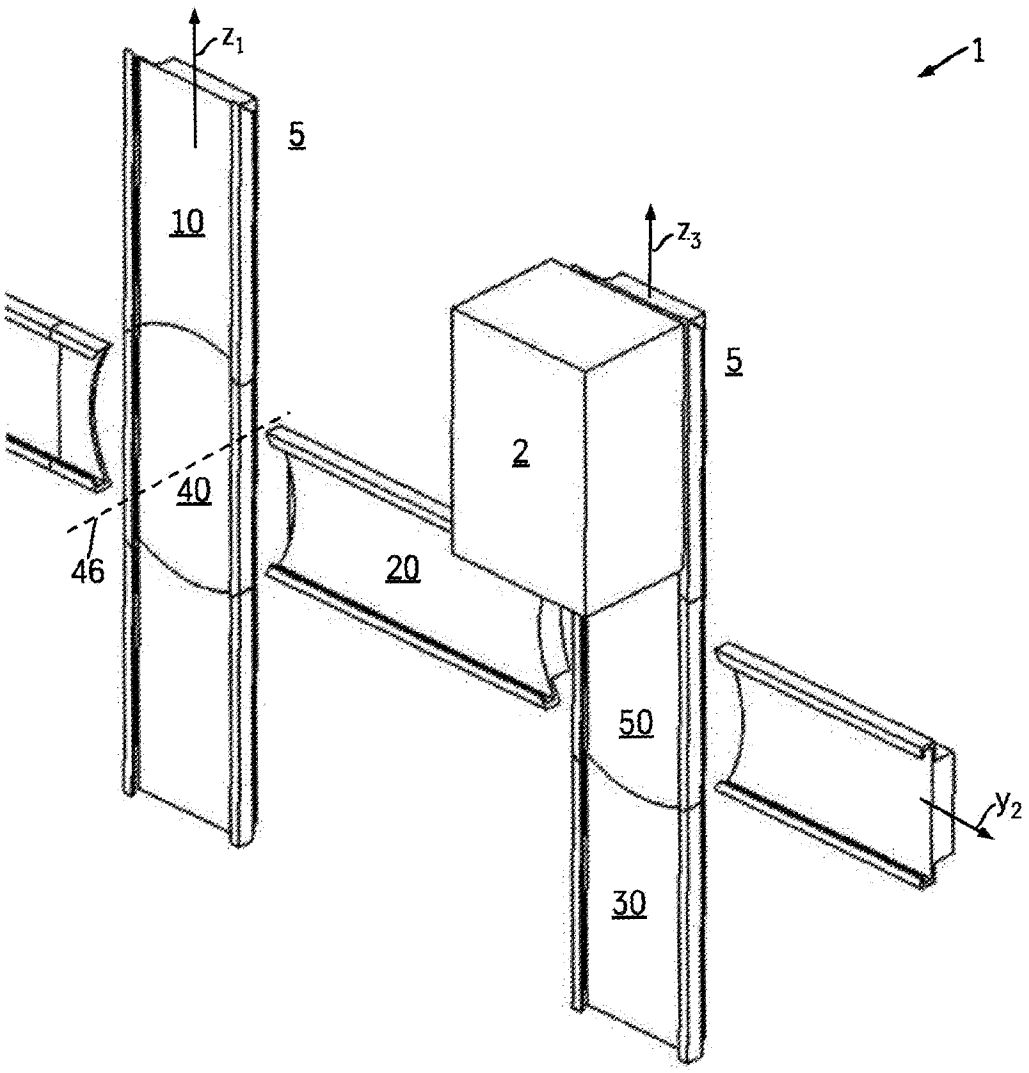
FIG. 1 is a sectional perspective view of an example elevator system.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

According to the invention, the method comprises the following process steps:

positioning of the car into a transfer position on the rotatable rail segment, while the rotatable rail segment is aligned with the first guide rail;

rotation of the rotatable rail segment in such a manner that it is aligned with the second rail segment, wherein a movement of the rotatable rail segment is braked by means of a rotary brake, in particular;

subsequent securing of the rotational position of the rotatable rail segment in respect of the shaft wall by securing a third locking device.

According to the invention, the assembly of the locking device comprises a third locking device for securing a rotational position of the rotatable rail segment in respect of the shaft wall.

The essence of the invention is, in particular, increased safety through the locking of the rotatable rail segment in respect of the shaft wall in the respective rotational positions. Only when the rotational position is adopted can a release be given allowing the chassis to travel on the rotatable rail segment. A large number of risks which could result from accidental rotation of the rotatable rail segment are thereby eliminated. A further advantage in respect of the sole use of a rotary brake may lie in the preferred property of the locking device to adopt precisely two states, namely "secured" or "not secured" or "unsecured". In contrast to this, a brake can adopt the "active" or "released" states which, however, allows precise assignment of the rotational position. A brake may, in principle, be active or released in all rotational positions and/or rotational speeds, including in intermediate positions. The locking device preferably does not allow a secured state when the rotatable rail segment is in an intermediate position.

The securing of the third locking device preferably takes place only when the rotatable rail segment is aligned with one of the guide rails. Intermediate rotational positions between the joint aligned rotational positions therefore inevitably result in an unsecured third locking device.

During movement of the car on the rotatable rail segment, in particular during the positioning of the car in the transfer position, the rotatable rail segment is preferably secured in respect of the shaft with the help of the third locking device, and before the rotatable rail segment is rotated, the third locking device is unlocked. This ensures that a movement of the car on the rotatable rail segment is only possible when the rotational positon of the rotatable rail segment is secured and aligned. The locking device must be unlocked prior to rotation.

During the unlocking of the third locking device a rotary brake of the rotary drive is preferably always activated. This ensures that there is no sudden unwanted rotational movement when the third locking device is released. The activated rotary brake means that the rotatable rail segment is directly subject to a control mechanism for controlling the rotational position.

A rotational axis of the rotary joint is preferably aligned in the transfer position with a rotational axis of the rotatable rail segment. During the rotation of the rotatable rail segment, a rotational axis of the rotary joint is preferably constantly aligned with a rotational axis of the rotary drive. In this way, a comfortable transfer of the car can be achieved. In the best case, the rotation of the rotatable rail segment therefore has no accelerating effect on the, particularly lateral, position of the car. The rotation of the rotary joint in this case can be completely balanced by the rotation of the chassis caused by the rotary drive, so that there is no positional change of the car.

During the rotation of the rotatable rail segment the car positioned on the rotatable rail segment is preferably secured in respect of the shaft by means of a second locking device. The second locking device particularly ensures that the rotational position of the car and, in particular, also the position in the shaft during the rotating operation remains, at least substantially, constant. In addition, the locking device may guarantee safety during accidental release of the travel brake between the chassis and the rail. During rotation, the rotatable rail segment is temporarily out of alignment with the stationary guide rails. If the chassis should complete a travel movement in this position, there is therefore a derailing risk. In the case of a cable-free elevator, derailing may signify the failure of all safety devices such as the safety gear, for example. To this extent, derailing must be precluded at all costs. The second locking device prevents a movement of the car and therefore traveling of the chassis during the rotation, as a result of which the risk of derailing during rotation is avoided.

During a movement of the car along one of the guide rails, the car is advantageously secured by means of a first locking device to prevent rotation in respect of the chassis. Despite the rotatable mounting on the chassis, the rotational position of the car is thereby secured. This applies particularly in the case of movement on straight guide rails. There may be a deviation from this in the case of curved guide rails, as the rotational position in respect of the chassis has to be constantly readjusted in this case, in order to keep the car alignment constant.

Consequently, the assembly preferably comprises a first locking device for securing the car against rotation in respect of the chassis during movement of the car, and/or a second locking device for securing the car positioned on the rotatable rail segment in respect of the shaft.

The elevator system preferably comprises an additional service brake for braking a traveling movement of the chassis on the guide rails and/or the rotatable rail segment and/or a rotary brake for braking a rotational movement of the rotatable rail segment.

The precisely two states of the first, second and/or third locking devices, in particular, can be clearly determined by means of sensors of the elevator system, which are not described in greater detail, and used for further control functions, in particular for a release for movement of the car and/or for rotation of the rotatable rail segment.

The invention is particularly applicable in the case of elevator systems in which the elevator car is guided with the help of a rucksack-type mounting on the guide rail. In the case of a rucksack-type mounting, the guide rails which support the car are all located on one side of the car. The car is suspended in the elevator shaft in a self-supporting manner, as it were, on only one side. This mounting concept is characterized in that the guide rails are only arranged on one side of the car and therefore impede the car's movement as little as possible in the transverse direction too. In addition, the invention is particularly applicable in the case of elevator systems with cable-free drives, in particular elevator systems driven by means of linear motors.

The terms "first", "second", "third" are only used to identify individual elements and do not imply a number of elements.

FIG. 1 shows parts of an elevator system 1 according to the invention. The elevator system 1 comprises a first guide rail 10 along which an elevator car 2 can be guided with the help of a rucksack-type mounting. The first guide rail 10 is vertically aligned in a first direction $z_1$ and means that the elevator car 2 can travel between different floors. Parallel to the first guide rail 10 is arranged a third guide rail 30 along which the elevator car 2 can be guided with the help of a rucksack-type mounting. The third guide rail 30 is aligned vertically in a third direction $z_3$ and likewise enables an elevator car 2 mounted thereon to travel between different floors. Cars which travel along the first guide rail 10 can be moved largely independently and unimpeded by cars on the second guide rail 30.

The elevator system 1 further comprises a second guide rail 20 along which the elevator car 2 can be guided with the help of the rucksack-type mounting. The second guide rail 20 is oriented horizontally in a second direction $y_2$ and enables the elevator car 2 to travel within a floor. In addition, the second guide rail 20 connects the first guide rail 10 to the third guide rail 30. The second guide rail 20 is therefore also used to transfer the car between the two vertical guide rails 10, 30, in order to implement modern paternoster operation, for example.

The elevator car 2 can also be switched from the first guide rail 10 to the second guide rail 20 via a first rotatable rail segment 40. The first rotatable rail segment 12 is rotatable in relation to a first rotational axis 46 which lies perpendicular to a y-z-plane which is spanned by the first guide rail 10 and the second guide rail 20. A second rotatable rail segment 50 which connects the second guide rail 20 to the third guide rail 30 is identically configured.

All rails 10, 20, 30, 40, 50 are fastened at least indirectly to at least one shaft wall 5, which form a shaft. The shaft wall 5 therefore defines the stationary reference system of the shaft. The term "shaft wall" 5 also includes a stationary framework structure which supports the rails.

Systems of this kind are described in essence in WO 2015/144781 A1 and also in German patent applications 10 2016 211 997.4 and 10 2015 218 025.5.

The processes involved in the changeover of the car 2 from the first guide rail 10 to the second guide rail 20 via the rotatable rail element 40 are explained with the help of FIGS. 2 to 12.

Figure 2:
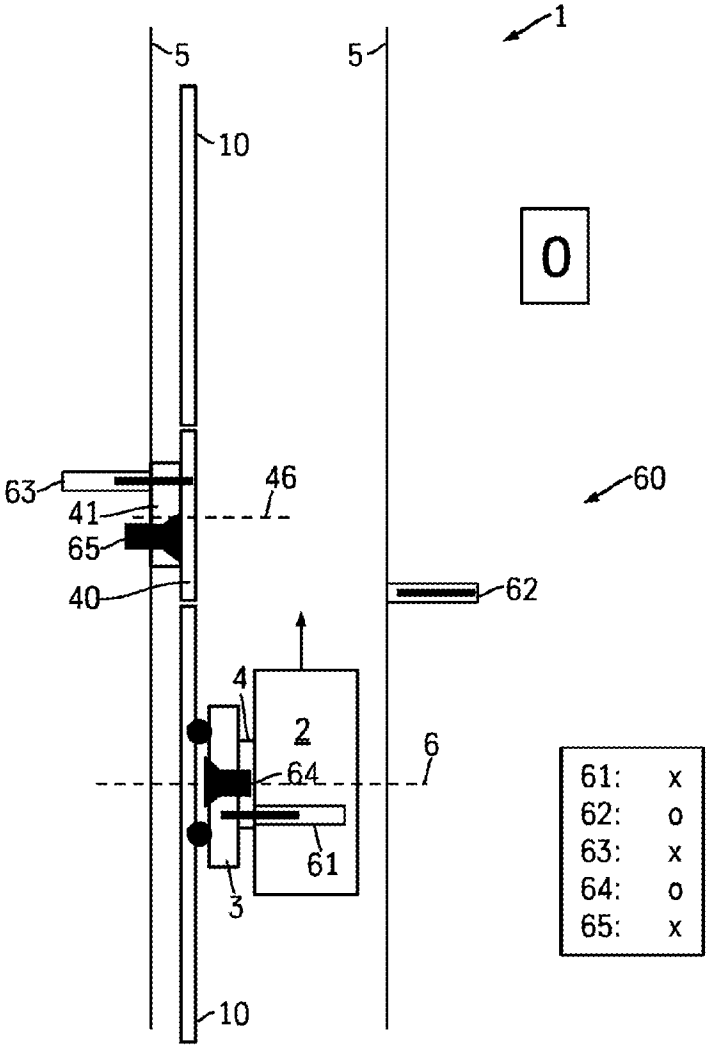

FIG. 2 shows an initial position (step 0). The car 2 is located on the first guide rail 10 starting up on the rotatable rail segment 40. The car 2 is guided on a chassis 3 with rollers in relation to the guide rail 10. The rollers partially engage behind the guide rail 10, as a result of which the rucksack-type mounting is made possible. The car 2 is connected to the chassis 3 via a rotary joint 4. The rotary joint 4 allows a rotation of the chassis 3 in respect of the car 2 about a pivot axis 6.

The first rotatable rail segment 40 is aligned with the first guide rail 10, so that the chassis 3 of the first guide rail 10 can travel on the first rotatable rail segment 20.

The rotatable rail segment 40 is kept stationary on a shaft wall 5. The rotational position of the rotatable rail segment about the rotational axis 46 can be changed via the rotary drive 41. A suitable rotary drive is described in principle in German patent application 10 2016 205 794.4, for example, under the term "drive unit" in that case.

During the start-up on the rotatable rail segment 40, the rotational position of the car 2 is secured in respect of the chassis 3 via a first locking device 61. A rotation of the rotary joint is prevented in the secured state. The first locking device 61 may comprise a bolt which, in the secured state, is an integral part of a form-fitting and non-rotational connection between the car 2 and the chassis 3. In the unsecured state, on the other hand, the form-fitting and non-rotation connection between the car 2 and the chassis 3 via the first locking device 61 is interrupted.

During the start-up on the rotatable rail segment 40 a second locking device 62, which is referred to in greater detail below, is in an unsecured state.

During the start-up on the rotatable rail segment 40, the rotational position of the rotatable rail segment 40 is secured in respect of the elevator shaft 5 via a third locking device 63. Rotation of the rotary drive 41 is prevented in the secured state. The third locking device 63 may comprise a bolt which is an integral part of a form-fitting and non-rotational connection between the rotatable rail segment 40 and the elevator shaft 5 in the secured state. In the unsecured state, on the other hand, the form-fitting and non-rotational connection between the rotatable rail segment 40 and the elevator shaft 5 via the third locking device 63 is interrupted.

In addition, a rotary brake 65 is provided on the rotary drive 41, which rotary brake is primarily configured to brake a rotational movement of the rotatable rail segment 40. This may, in addition, be used to support the fixing of the rotatable rail segment 40 by the third locking device 63.

A service brake 64 is provided on the car 2, which brake is designed to reduce the travel speed. During the start-up on the rotatable rail segment 40 the service brake 64 is initially inactive, but may be used to reduce the traveling speed, particularly during downwards travel. Use of the service brake 64 is necessary during downwards travel; in the case of upwards travel, the reduction in travel speed can be effected by weight with a selective reduction in drive output.

In the box, the reference numbers of the locking devices are listed alongside an "x" or "o". An "x" means that the locking device 61, 62, 63 assigned the reference number is secured or the brake 64, 65 assigned the reference number is active. An "o" means that the locking device 61, 62, 63 assigned the reference number is unsecured or the brake 64, 65 assigned the reference number is released. In the subsequent figures, states which have changed compared with the previous figure are highlighted by being underlined.

Figure 3:
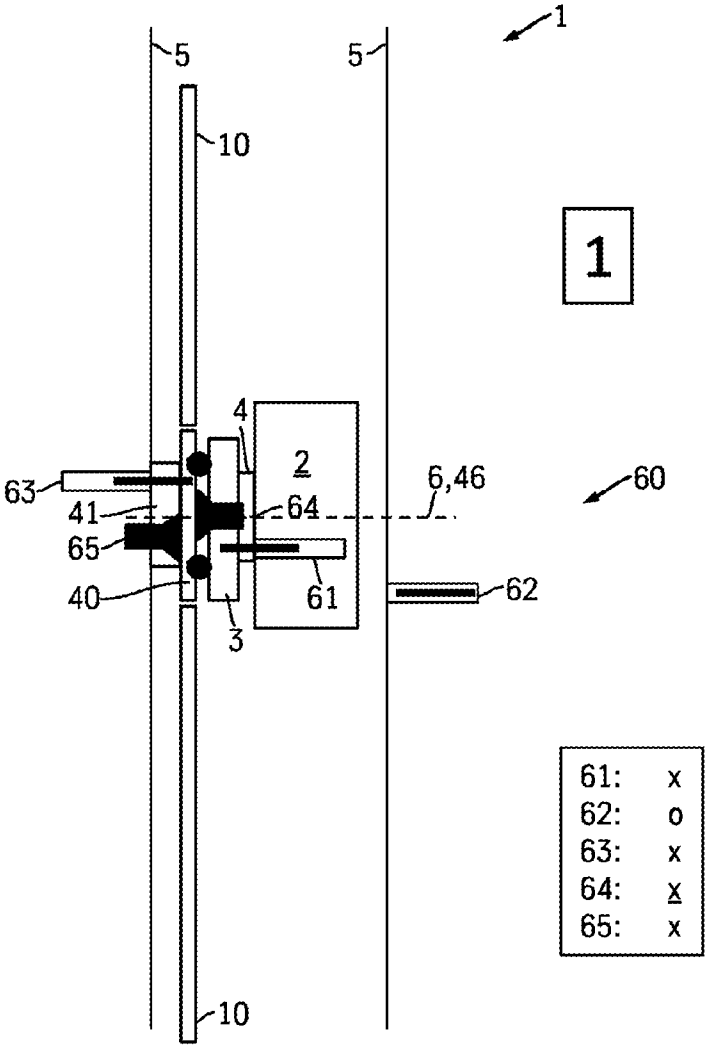
FIGS. 2-12 are schematic views illustrating a sequence of process steps during transfer of an elevator car from a first guide rail to a second guide rail in the example elevator system of FIG. 1.

FIG. 3 shows the car 2 in the transfer position thereof (step 1). The rotational axis 46 of the rotatable rail segment 40 in this case is aligned with the rotational axis 6 of the rotary joint 4. Through the alignment of these two rotational axes 6, 46 in respect of one another, the chassis 3 can be rotated without the car being exposed to impact in a lateral direction due to the rotation. This promotes a high standard of comfort for passengers. The travel brake 64 is activated.

Figure 4:
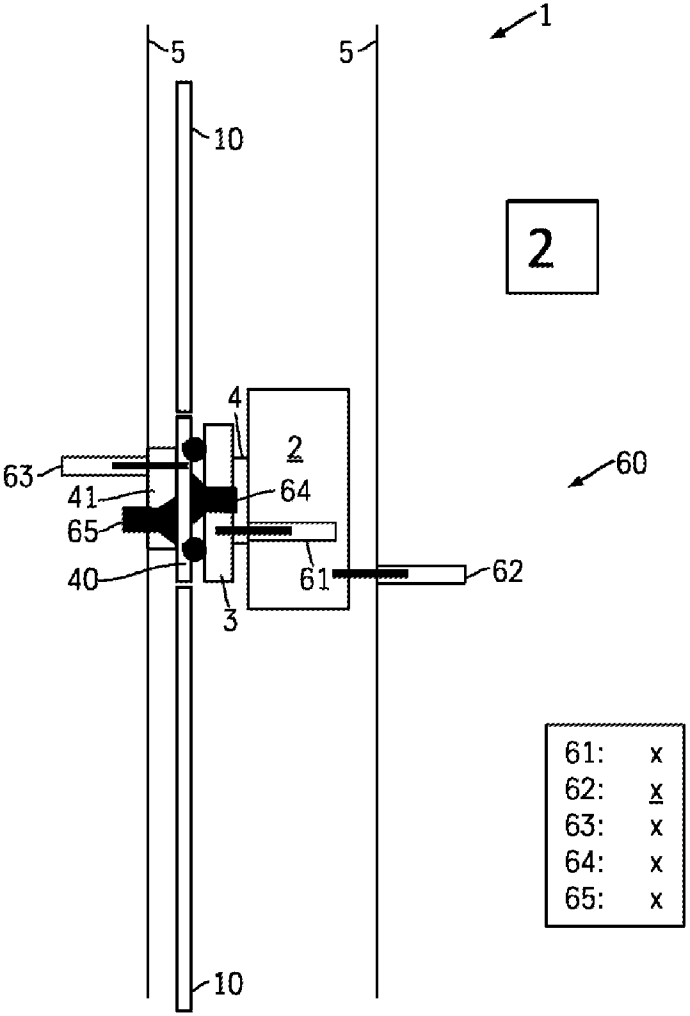
Figure 7:
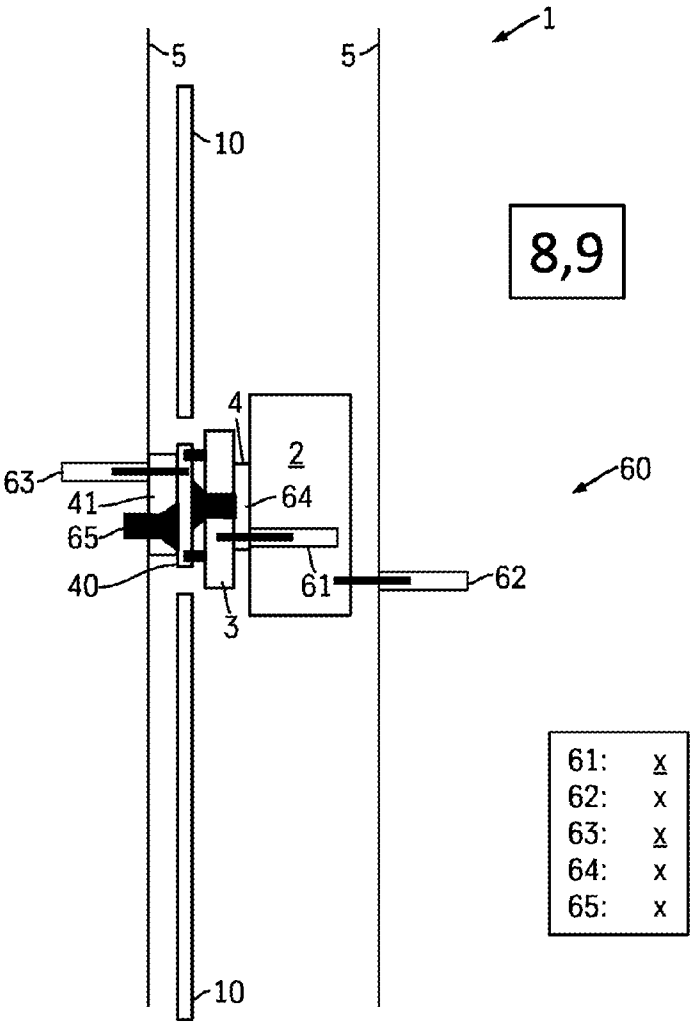

FIG. 4 furthermore shows the car 2 in the transfer position thereof. In addition, the second locking device 62 is secured (step 2). In this case, the rotational position of the car 2 and, optionally, the position of the car 2 along the travel path are secured in respect of the elevator shaft 5. A rotation of the car 2 in respect of the elevator shaft 5 and, optionally, a movement of the car 2 in respect of the elevator shaft 5 are prevented in the secured state. The second locking device 62 may comprise a bolt which, in the secured state, is an integral part of a form-fitting and non-rotational connection between the car 2 and the elevator shaft 5. In the unsecured state, on the other hand, the form-fitting and non-rotational connection between the car 2 and the elevator shaft via the second locking device 62 is interrupted.

Figure 5:
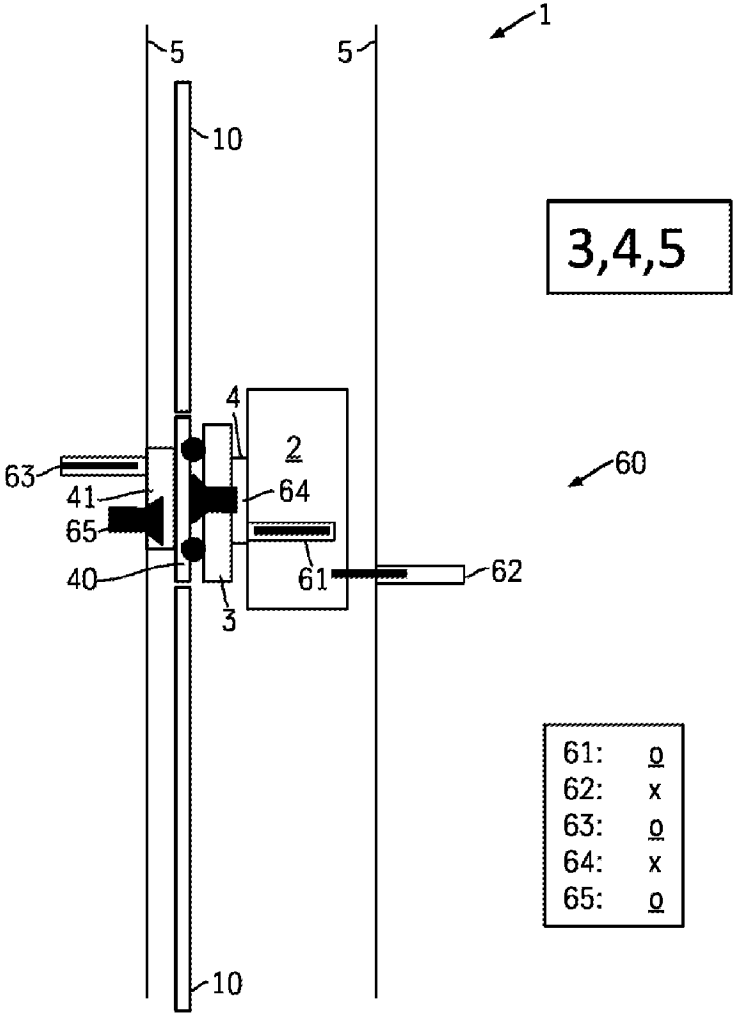

FIG. 5 furthermore shows the car 2 in the transfer position thereof. In a following step 3, the first locking device 61 is unlocked and in a subsequent step 4 the third locking device 63 is unlocked. Steps 3 and 4 can also be carried out in reverse order or simultaneously. In a further step 5 which may take place simultaneously with steps 3 and/or 4 or after steps 3 and 4, the rotary brake 65 is released. The travel brake 64 remains active, in order to keep the chassis 3 in position on the rotatable rail segment 40.

Figure 6:
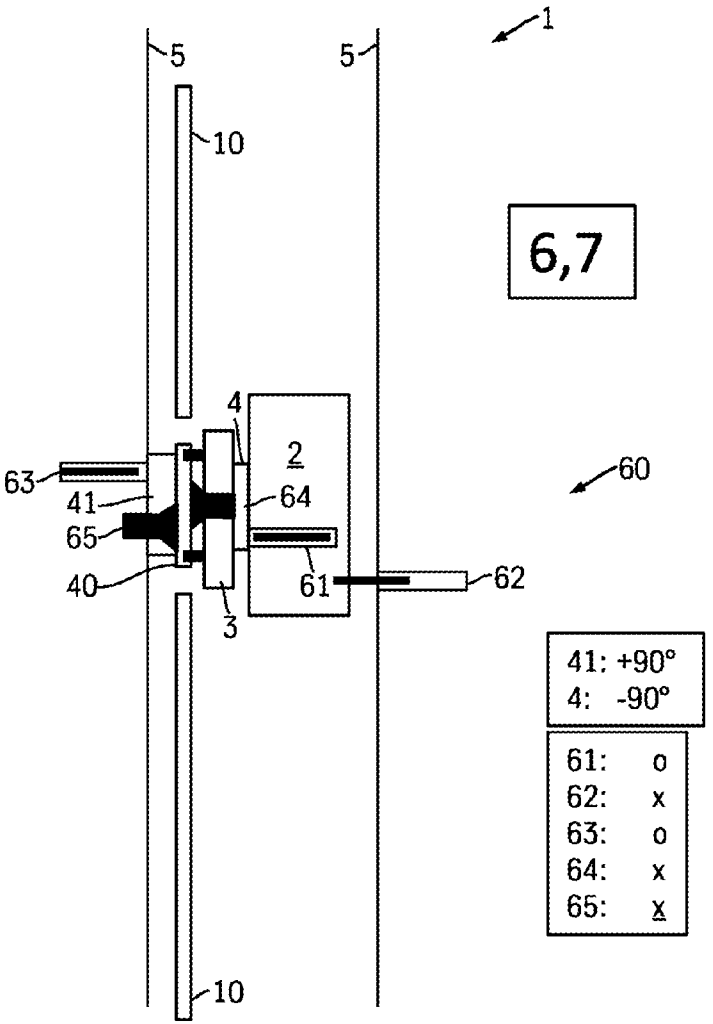

FIG. 6 shows the elevator system 1 after the rotary drive 41 has rotated the rotatable rail segment 40 through 90° in a following step 6. The rotatable rail segment is now aligned with the second guide rail 20. The rotary brake 65 was activated during rotation in step 7, in order to brake the rotational movement with utmost precision with alignment with the second direction $y_2$. By rotating the rotatable rail segment 40 in step 6, the pivot joint 4 is also rotated through −90°; the orientation of the car 2 does not change during this.

In two subsequent steps 8 and 9 (FIG. 7) the third locking device 63 and the first locking device 61 are secured. Steps 8 and 9 may be carried out one after the other, in reverse order or simultaneously.

In two following steps 10 and 11 (FIG. 8), the second locking device 61 is unlocked and the travel brake 64 is released. The release of the travel brake 64 may take place simultaneously with the unlocking of the second locking device 62.

In a subsequent step 12 (FIG. 9), the car leaves the rotatable rail segment on the second guide rail 40.

In subsequent steps 13 to 17 (FIGS. 11 to 12), the elevator system 1 is once again switched to the initial position (step 0). In the two subsequent steps 13 and 14 (FIG. 10), the third locking device 63 is unlocked and the rotary brake 65 is released. Steps 13 and 14 may be carried out one after the other or simultaneously. In the following step 15 (FIG. 11) the rotatable rail segment 40 is rotated through −90°. The rotatable rail segment 40 is now once again aligned with the first guide rail 10.

In the following two steps 16 and 17 (FIG. 12), the rotary brake 65 is activated and the third locking device 63 is secured. Steps 16 and 17 can be carried out consecutively or simultaneously. The initial position (step 0) is restored and a following car can travel from the first guide rail 10 onto the rotatable rail segment 40, in order to be transferred to the second guide rail 20.

Figure 9:
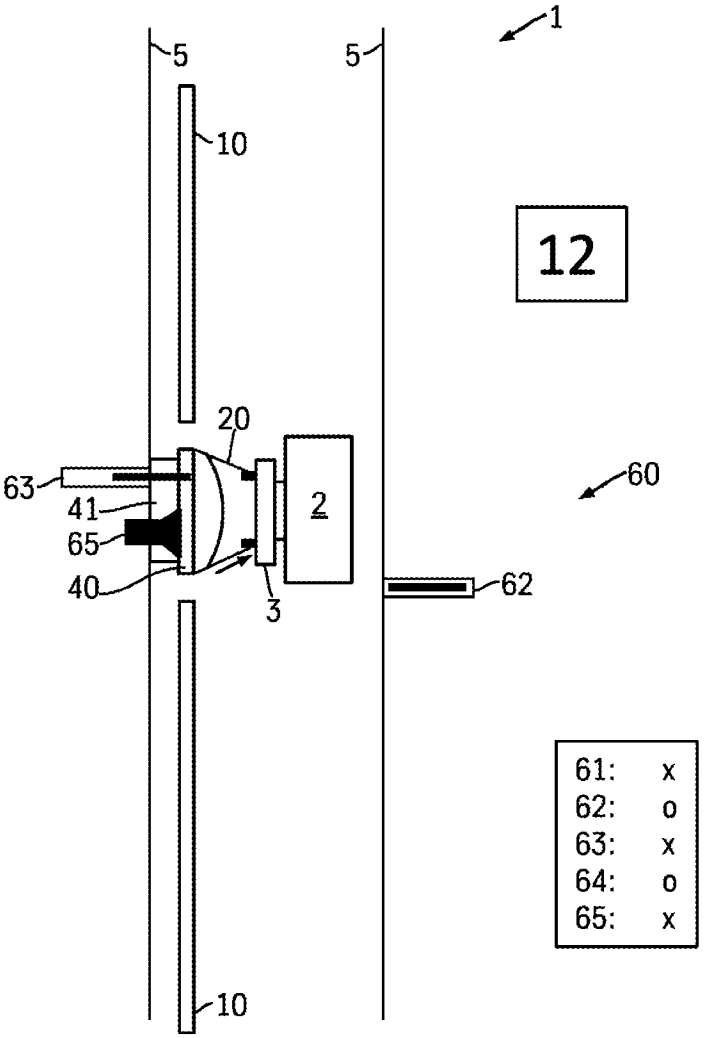
Figure 8:
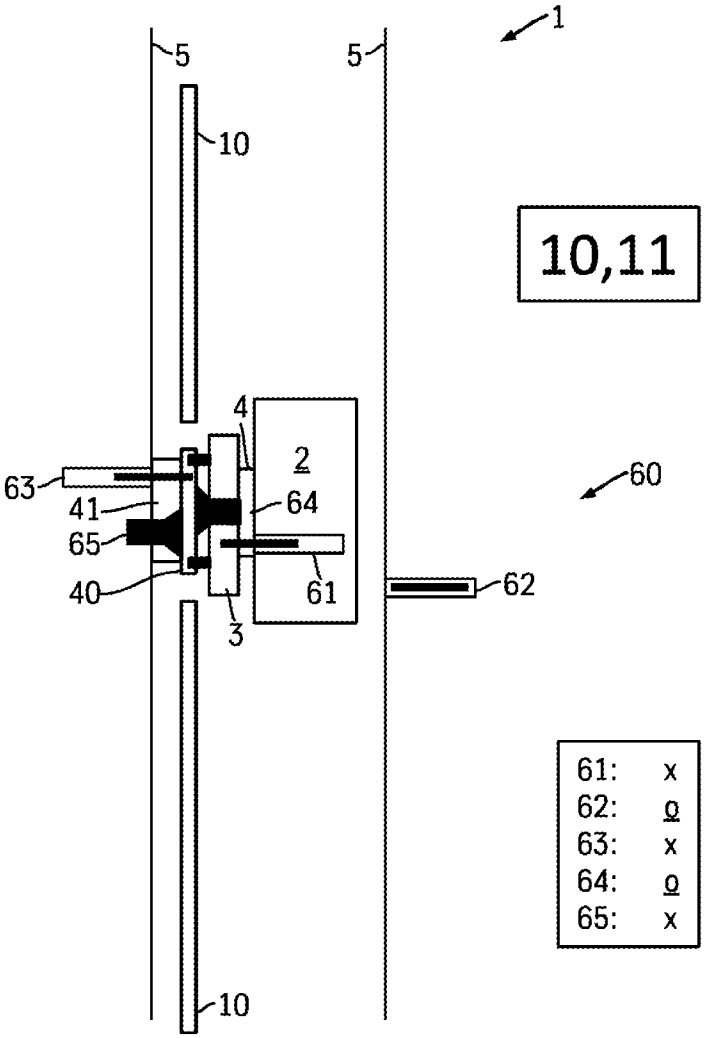
Figure 11:
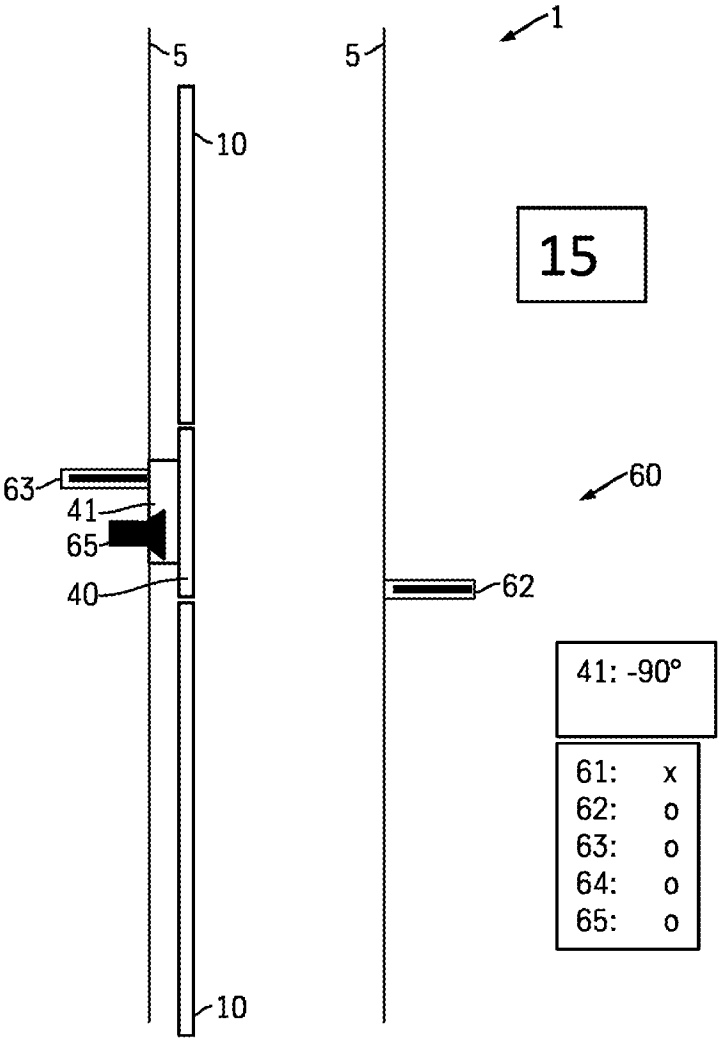
Figure 10:
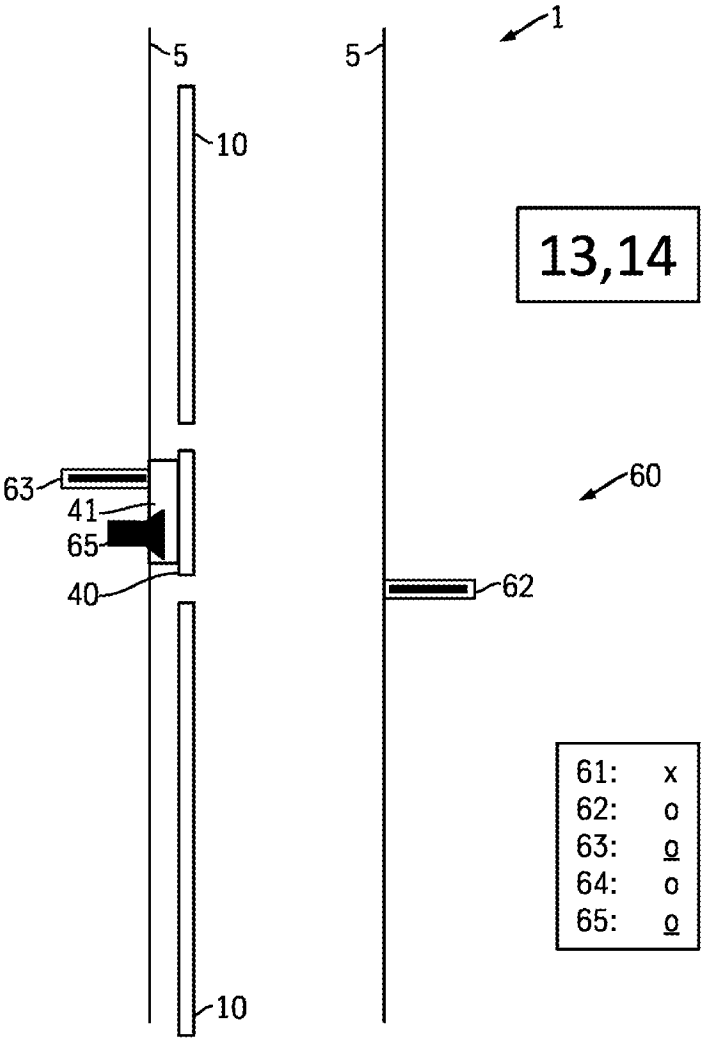
Figure 12:
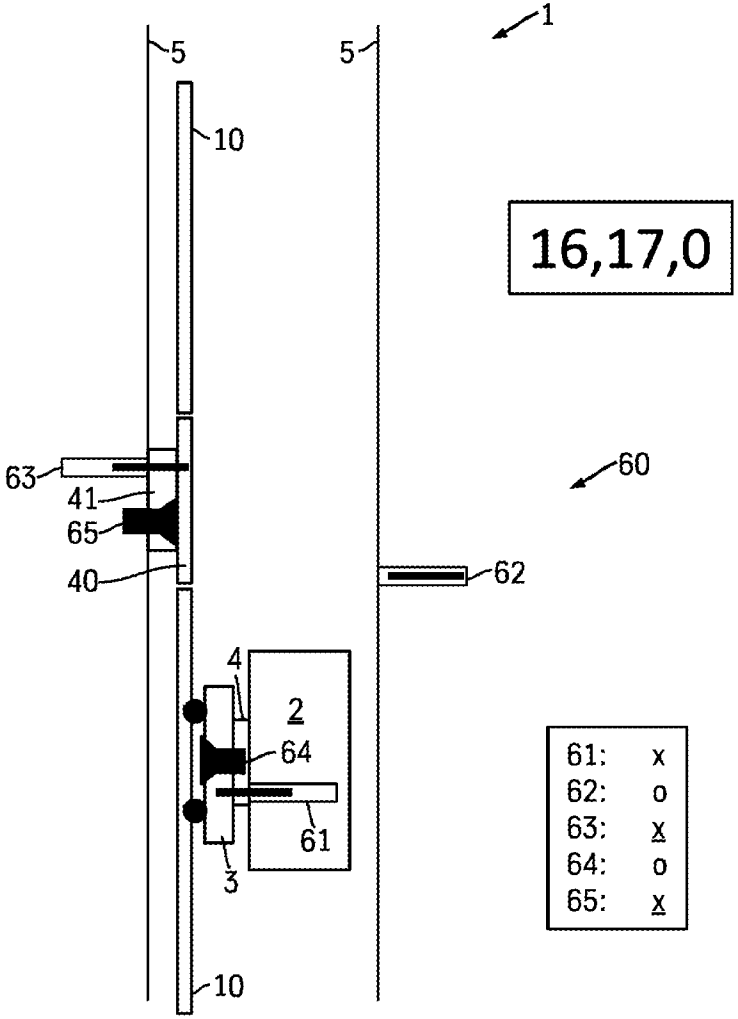

With all steps it is important to ascertain that a form-fitting, non-rotational connection constantly exists between the car 2 and the shaft 5. This form-fitting, non-rotational connection may, on the one hand, be created via the comparatively short connection by means of the second locking device 62, in particular when the car is not traveling (FIGS. 4 to 7). In other states, the form-fitting, non-rotational connection can be created by the secured first locking device 61, the chassis 4, the connection between the rollers and stationary guide rails 10, 20 (FIGS. 2 and 9). If, however, the chassis 3 should be arranged on the rotatable rail segment 40 and the second locking device 62 is not secured, the form-fitting, non-rotational connection is created by the secured first locking device 61, the chassis 4, the connection between the rollers and rotatable rail segments 40 and the secured third locking device (FIGS. 3 and 8).

LIST OF REFERENCE NUMBERS

1 elevator system
2 elevator car
3 chassis with rollers
4 rotary joint
5 shaft wall
6 rotational axis of the rotary joint
10 first vertical guide rail
20 second horizontal guide rail
30 third vertical guide rail
40 first rotatable rail segment
41 rotary drive
46 rotational axis of the rotatable rail segment
50 second rotatable rail segment
60 assembly of locking devices
61 first locking device
62 second locking device
63 third locking device
64 travel brake
65 rotary brake
$z_1$ first direction
y second direction
$z_3$ third direction

What is claimed is:

1. A method for operating an elevator system that comprises a first guide rail oriented in a first direction, a second guide rail oriented in a second direction, a shaft relative to which at least one of the first guide rail or the second guide rail is kept stationary, a rail segment that is rotatable relative to the shaft and that is switchable between an orientation in the first direction and an orientation in the second direction, an elevator car that is movable along the first and second guide rails by way of a chassis to which the elevator car is rotatably connected via a rotary joint and that is switchable between the first and second guide rails via the rail segment, and an assembly of locking devices configured to selectively secure an orientation of at least one of the elevator car or the rail segment, the method comprising:

guiding the elevator car via a rucksack-type mounting on one or more of the first guide rail, the second guide rail, or the rail segment;

positioning the elevator car into a transfer position on the rail segment while the rail segment is aligned with the first guide rail;

during said positioning of the elevator car, securing a rotational position of the rail segment relative to the shaft via a third one of the locking devices;

unlocking the third of the locking devices;

after said unlocking, rotating the rail segment into alignment with the second guide rail, wherein a movement of the rail segment is braked by a rotary brake; and after said rotating step, securing a rotational position of the rail segment relative to the shaft by securing the third of the locking devices.

2. The method of claim 1, wherein during said unlocking of the third of the locking devices, the method further comprises activating the rotary brake of a rotary drive.

3. The method of claim 1, further comprising aligning a rotational axis of the rotary joint in the transfer position with a rotational axis of the rail segment.

4. The method of claim 1, wherein during said rotating of the rail segment, the method further comprises constantly aligning a rotational axis of the rotary joint with a rotational axis of a rotary drive.

5. The method of claim 1, wherein during said rotating of the rail segment, the method further comprises securing the elevator car positioned on the rail segment relative to the shaft by a second of the locking devices.

6. The method of claim 1, wherein said securing of the third of the locking devices occurs only when the rail segment is aligned with one of the guide rails.

7. The method of claim 1, wherein the first direction is one of a vertical or horizontal direction, and the second direction is the other of a vertical or horizontal direction.

8. A method for operating an elevator system that comprises a first guide rail oriented in a first direction, a second guide rail oriented in a second direction, a shaft relative to which at least one of the first guide rail or the second guide rail is kept stationary, a single rail segment disposed between the first and second guide rails that is rotatable relative to the shaft and that is switchable between an orientation in the first direction and an orientation in the second direction, an elevator car that is movable along the first and second guide rails by way of only a single chassis to which the elevator car is rotatably connected via only a single rotary joint and that is switchable between the first and second guide rails via the single rotatable rail segment, and an assembly of locking devices configured to selectively secure an orientation of at least one of the elevator car or the rail segment, the method comprising:

positioning only the single chassis and the elevator car connected thereto into a transfer position located on the single rail segment while the rail segment is aligned with the first guide rail;

rotating the rail segment into alignment with the second guide rail, wherein a movement of the rail segment is braked by a rotary brake;

after rotating the rail segment, securing a rotational position of the rail segment relative to the shaft by securing a third one of the locking devices;

moving the elevator car along one of the first or second guide rails; and during said moving, securing the elevator car by a first of the locking devices to prevent rotation of the elevator car relative to the chassis.

9. The method of claim 8, further comprising guiding the elevator car via a rucksack-type mounting on the guide rails.

10. The method of claim 9, further comprising driving the elevator car in a cable-free manner.

11. The method of claim 8, wherein said securing of the third of the locking devices occurs only when the rail segment is aligned with one of the guide rails.

12. The method of claim 8, wherein the first direction is one of a vertical or horizontal direction, and the second direction is the other of a vertical or horizontal direction.

13. A method for operating an elevator system that comprises a first guide rail oriented in a first direction, a second guide rail oriented in a second direction, a shaft relative to which at least one of the first guide rail or the second guide rail is kept stationary, a rail segment that is rotatable relative to the shaft and that is switchable between an orientation in the first direction and an orientation in the second direction, an elevator car that is movable along the first and second guide rails by way of a chassis to which the elevator car is rotatably connected via a rotary joint and that is switchable between the first and second guide rails via the rail segment, and an assembly of locking devices configured to selectively secure an orientation of at least one of the elevator car or the rail segment, the method comprising:

positioning the elevator car into a transfer position on the rail segment while the rail segment is aligned with the first guide rail;

locking the elevator car to the elevator shaft by a form-fitting, non-rotational connection established between the shaft and the car, that is formed via the assembly of locking devices, so as to prevent a change in the rotational position of the elevator car in the shaft;

rotating the rail segment into alignment with the second guide rail while maintaining the form-fitting, non-rotational connection lock between the elevator car and the shaft, wherein a movement of the rail segment is braked by a rotary brake; and after rotating the rail segment, securing a rotational position of the rail segment relative to the shaft by securing a third one of the locking devices.

14. The method of claim 13, wherein said securing of the third of the locking devices occurs only when the rail segment is aligned with one of the guide rails.

15. The method of claim 13, wherein the first direction is one of a vertical or horizontal direction, and the second direction is the other of a vertical or horizontal direction.

* * * * *